US005996701A

United States Patent [19]

Fukasawa et al.

[11] Patent Number: 5,996,701

[45] Date of Patent: Dec. 7, 1999

[54] CONTROL METHOD AND SYSTEM FOR CONSTRUCTION MACHINE

[75] Inventors: Toshihiko Fukasawa; Shigeru Yamamoto; Hisao Asada; Yasuo Fujiwara; Tomohiro Nakagawa, all of Hirakata, Japan

[73] Assignee: Komatsu Ltd., Tokyo, Japan

[21] Appl. No.: 09/196,184

[22] Filed: Nov. 20, 1998

[30] Foreign Application Priority Data

Dec. 19, 1997 [JP] Japan ..... 9-350386

[51] Int. Cl.[6] ..... E02F 3/84

[52] U.S. Cl. ..... 172/2; 172/812; 701/50

[58] Field of Search ..... 172/2, 3, 4, 4.5, 172/7, 8, 9, 10, 11, 12, 812; 701/50

[56] References Cited

U.S. PATENT DOCUMENTS 3,583,243 6/1971 Wilson ..... 74/15.84
4,529,039 7/1985 Sakundiak ..... 172/4

FOREIGN PATENT DOCUMENTS 57-58739 4/1982 Japan .
57-133940 8/1982 Japan .
3-70885 3/1991 Japan .
6-108497 4/1994 Japan .
7-127605 5/1995 Japan .
10-219733 8/1998 Japan .

*Primary Examiner*—Christopher J. Novosad
*Attorney, Agent, or Firm*—Armstrong, Westerman, Hattori, McLeland & Naughton

[57] ABSTRACT

An independent two pump system comprising an implement hydraulic pump and a steering hydraulic pump is described. The system has an inexpensive structure and the capability of preventing a construction machine from engine stalling without impairing fuel economy. When the implement hydraulic pump is actuated with the output of an engine to operate an implement attached to the construction machine, while actuating the steering hydraulic pump with the output of the engine to turn a vehicle body of the machine, the load exerted on the implement is detected and if the detected load is determined to exceed a preset value, the displacement of the steering hydraulic pump is reduced to thereby reduce the load associated with turning of the vehicle body.

10 Claims, 7 Drawing Sheets

CONTROL METHOD AND SYSTEM FOR CONSTRUCTION MACHINE

TECHINCAL FIELD

The present invention relates to a method and system for controlling an attached implement and a steering system in a construction machine in relation with each other.

BACKGROUND ART

In a conventional construction machine such as a bulldozer, the "independent two pump system" is employed to ensure hydraulic power required for carrying out operation of the attached implement such as a blade and ripper and turning of the vehicle body at the same time. In this system, two separate pumps are used, one being an implement hydraulic pump for supplying hydraulic power to the implement, and the other being a steering hydraulic pump for supplying hydraulic power to the steering hydraulic motor.

In this known system, variable displacement hydraulic pumps are used as the implement hydraulic pump and the steering hydraulic pump, for the purpose of preventing possible engine stalling when these pumps are simultaneously operated. By use of such pumps, horse power consumption can be reduced and engine torque rise and the amount of torque required for travelling in the low speed range are set high.

A prior art relating to the present invention is disclosed in Japanese Patent Publication (KOKAI) No. 57-133940 (1982). This publication discloses a construction machine which employs a single motor for operating three hydraulic pumps (two variable displacement pumps and one fixed displacement pump). When this construction machine is not in turning motion, the sum of horse power input to the variable displacement pumps which are not for use in turning operation is set to a value obtained by subtracting a certain amount from the total output horse power of the motor, whereas the discharged fluid of the fixed displacement pump used for turning operation is allowed to join the fluid pressure circuit which is not for turning operation. On the other hand, when the construction machine is in turning motion, the sum of horse power input to the variable displacement pumps not for use in turning operation is first made to be substantially equal to the total output horse power of the motor and is then allowed to decrease as the discharged horse power of the fixed displacement pump for turning operation increases. In this way, the total of horse power input to the three hydraulic pumps is maintained to be substantially constant.

Systems using variable displacement pumps both for the implement hydraulic pump and for the steering hydraulic pump, like the conventional independent two pump system, require an auxiliary machine such as a turbo-charger or after-cooler in order to increase engine torque rise, resulting in poor cost performance and poor fuel economy. Two variable displacement hydraulic pumps complex in structure are essential for the conventional two pump system, and installation of two variable displacement pumps makes the entire system bulky and costly.

The related art disclosed in the publication No. 57-133940 is designed to allow the discharged fluid of the pump for turning operation to join the fluid pressure circuit not for use in turning operation and is therefore inapplicable to construction machines such as described in the invention in which there is a big difference in pressure between the implement hydraulic circuit and the steering hydraulic circuit.

The present invention is directed to overcoming the above problems and the primary object of the invention is therefore to provide a control method and system for a construction machine, which employ the independent two pump system including an implement hydraulic pump and a steering hydraulic pump, the method and system capable of preventing engine stalling with inexpensive system structure and without increasing fuel cost.

DISCLOSURE OF THE INVENTION

The above object can be achieved by a method for controlling a construction machine according to the invention, wherein an implement hydraulic pump is actuated by the output of an engine to operate an implement attached to the construction machine and a variable displacement steering hydraulic pump is actuated by the output of the engine to turn a vehicle body of the construction machine, and wherein a load exerted on the implement is detected and if it is determined that the detected load exceeds a preset value, the displacement of the steering hydraulic pump is reduced to reduce the load associated with turning of the vehicle body.

In the control method of the invention, when the implement and the steering system are both in operation, the load imposed on the implement is detected. If the detected load exceeds a preset value, the steering hydraulic pump is controlled to reduce its displacement so that engine stalling can be prevented. Therefore, the engine torque necessary for travelling in the medium speed range or low speed range can be reduced to restrict the torque rise of the engine. This arrangement eliminates the need for installation of an auxiliary machine such as a turbo-charger or after-cooler, and therefore enables a fuel-efficient construction machine with inexpensive system structure. In addition, a compact, fixed displacement pump can be used as the implement hydraulic pump, which results in more simplified system structure.

In the invention, it is preferable to change the aforesaid preset value according to the type of operation to be carried out and the soil condition of the field. Specifically, a threshold for the load exerted on the implement, which is used for determining a start time for the control of restricting the displacement of the steering hydraulic pump, is set according to the type of operation such as leveling, digging/carrying, side cutting, or scraping or according to the type of soil such as hard rock or sand, whereby the optimum control for the operation to be carried out and the soil condition of the field can be performed.

The above control method for a construction machine can be put into practice by using the construction machine control system of the invention. According to a first aspect, there is provided a control system for a construction machine, the system comprising an implement hydraulic circuit for actuating an implement hydraulic pump with the output of an engine to operate an implement attached to the construction machine, and a steering hydraulic circuit for actuating a variable displacement steering hydraulic pump with the output of the engine to turn a vehicle body of the construction machine by a steering hydraulic motor, the system further comprising:

(a) first horse power consumption detecting means for detecting the actual horse power consumption of the implement hydraulic pump;

(b) second horse power consumption detecting means for detecting the actual horse power consumption of the steering hydraulic pump;

(c) controlling region determining means for making a judgement whether or not the sum of the actual horse power consumption detected by the first and second horse power consumption detecting means falls within a specified controlling region in a map associated with the horse power consumption of the pumps; and (d) swash plate angle controlling means for controlling the angle of a swash plate for the steering hydraulic pump if the controlling region determining means judges that the sum of the actual horse power consumption falls within the specified controlling region.

In the construction machine control system having the first feature, the actual horse power consumption of the implement hydraulic pump is detected by the first horse power consumption detecting means while the actual horse power consumption of the steering hydraulic pump is detected by the second horse power consumption detecting means. If the sum of these detected values of horse power consumption is determined to be within a specified controlling region in a pump horse power consumption map, the angle of the swash plate for the steering hydraulic pump is adjusted by the swash plate angle controlling means. Thus, engine stalling can be prevented while restricting the torque rise of the engine, so that the fuel cost required for traveling in the medium or low speed range can be saved.

It is preferable in this system to use a fixed displacement hydraulic pump as the implement hydraulic pump. This leads to simplification of the structure of the hydraulic circuit and makes the pump itself compact.

The swash plate angle controlling means may control the angle of the swash plate so as to reduce the displacement of the steering hydraulic pump if the controlling region determining means judges that the total horse power consumption falls within the specified controlling region. More concretely, if the controlling region determining means judges that the total horse power consumption falls within the specified controlling region, the swash plate angle controlling means calculates a pump capacity correction value $q_0$ for the steering hydraulic pump from the following equation:

$$q_0=q_s-(L_p-L_0)/(\beta\cdot P_S\cdot N_E)$$

$q_s$: the capacity of the steering hydraulic pump $L_p$: the sum of the actual horse power consumption $L_0$: a limit for the horse power consumption of the pumps $\beta$: a constant $P_S$: the discharge pressure of the steering hydraulic pump $N_E$: the rotational speed of the engine Then, the swash plate angle controlling means outputs a signal indicative of a current value corresponding to the calculated pump capacity correction value $q_0$ in order to control the angle of the swash plate for the steering hydraulic pump.

According to a second aspect, there is provided a control system for a construction machine, the system comprising an implement hydraulic circuit for actuating an implement hydraulic pump with the output of an engine to operate an implement attached to the construction machine, and a steering hydraulic circuit for actuating a variable displacement steering hydraulic pump with the output of the engine to turn a vehicle body of the construction machine by a steering hydraulic motor, the system further comprising:

(a) circuit hydraulic pressure detecting means for detecting the hydraulic pressure of the implement hydraulic circuit;

(b) controlling region determining means for judging whether or not the hydraulic pressure detected by the circuit hydraulic pressure detecting means falls within a specified controlling region in a map associated with the hydraulic pressure of the circuit; and (c) swash plate angle controlling means for controlling the angle of a swash plate for the steering hydraulic pump if the controlling region determining means judges that the detected hydraulic pressure of the circuit falls within the specified controlling region.

In the construction machine control system having the second feature, the hydraulic pressure of the implement hydraulic circuit is detected by the circuit hydraulic pressure detecting means and if it is determined that the detected hydraulic pressure falls in a specified controlling region in a circuit hydraulic pressure map, the angle of the swash plate for the steering hydraulic pump is controlled by the swash plate angle controlling means. This control system can prevent engine stalling while restricting the torque rise of the engine, similarly to the construction machine control system having the first feature. Further, this control system does not need to detect the rotational speed of the engine etc. in order to calculate horse power consumption unlike the first control system, so that the desired control can be performed more easily.

It is preferable that the implement hydraulic pump in this system be a fixed displacement hydraulic pump. This leads to simplification of the structure of the hydraulic circuit and makes the pump itself compact.

The swash plate angle controlling means may control the angle of the swash plate so as to reduce the displacement of the steering hydraulic pump if the controlling region determining means judges that the detected circuit hydraulic pressure falls within the specified controlling region. More concretely, if the controlling region determining means judges that the detected circuit hydraulic pressure falls within the specified controlling region, the swash plate angle controlling means calculates a pump capacity correction value $q_0$ for the steering hydraulic pump from the following equation:

$$q_0=a\cdot q_s$$

$q_s$: the capacity of the steering hydraulic pump a: correction coefficient that satisfies $0<a<1$ Then, the swash plate angle controlling means outputs a signal indicative of a current value corresponding to the calculated, pump capacity correction value $q_0$ in order to control the angle of the swash plate for the steering hydraulic pump.

BEST MODE FOR CARRYING OUT THE INVENTION

Reference is now made to the accompanying drawings to describe preferred embodiments of the control method and control system for a construction machine according to the invention, where the invention is applied to a bulldozer.

(First Embodiment)

Figure 1:
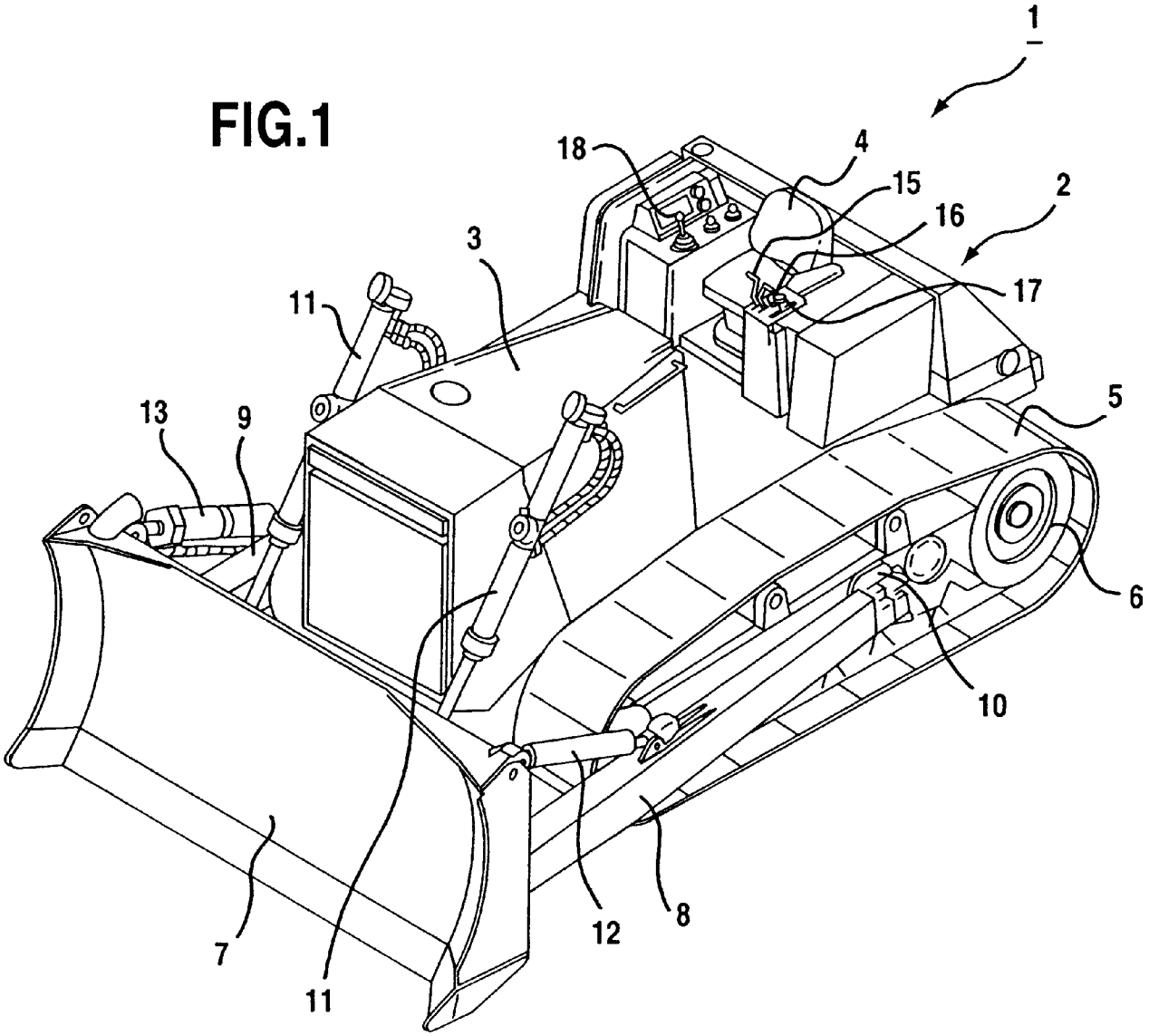
FIG. 1 is an outside view of a bulldozer to which a first embodiment of the invention is applied.

FIG. 1 shows an outside view of a bulldozer 1 according to a first embodiment.

In this embodiment, the bulldozer 1 has a vehicle body 2 on which a bonnet 3 and a cab 4 are provided. Disposed on both right and left sides of the vehicle body 2 are crawler belts 5 for moving the vehicle body so as to travel forward or backward, or to turn. The crawler belts 5 are respectively independently driven by driving power transmitted from an engine with the aid of their corresponding sprockets 6.

There are provided right and left straight frames 8, 9 for supporting a blade 7 at their leading ends. The base ends of the frames 8, 9 are pivotally supported at the sides of the vehicle body 2 through trunnions 10 (the trunnion on the right side is not shown in the drawing) such that the blade 7 can be lifted or lowered. A pair of blade lift cylinders 11 are disposed between the blade 7 and the vehicle body 2, for lifting or lowering the blade 7. A brace 12 is disposed between the blade 7 and the left straight frame 8 while a blade tilt cylinder 13 is disposed between the blade 7 and the right straight frame 9. The brace 12 and the blade tilt cylinders 13 function to tilt the blade 7 laterally.

There are provided, on the left side of the cab 4, a steering lever 15, a gear shift lever 16 and a fuel controlling lever 17. On the right side of the cab 4 is provided a blade controlling lever 18 for lifting, lowering and laterally tilting the blade 7. A deceleration pedal (not shown) is disposed in front of the cab 4.

Figure 2:
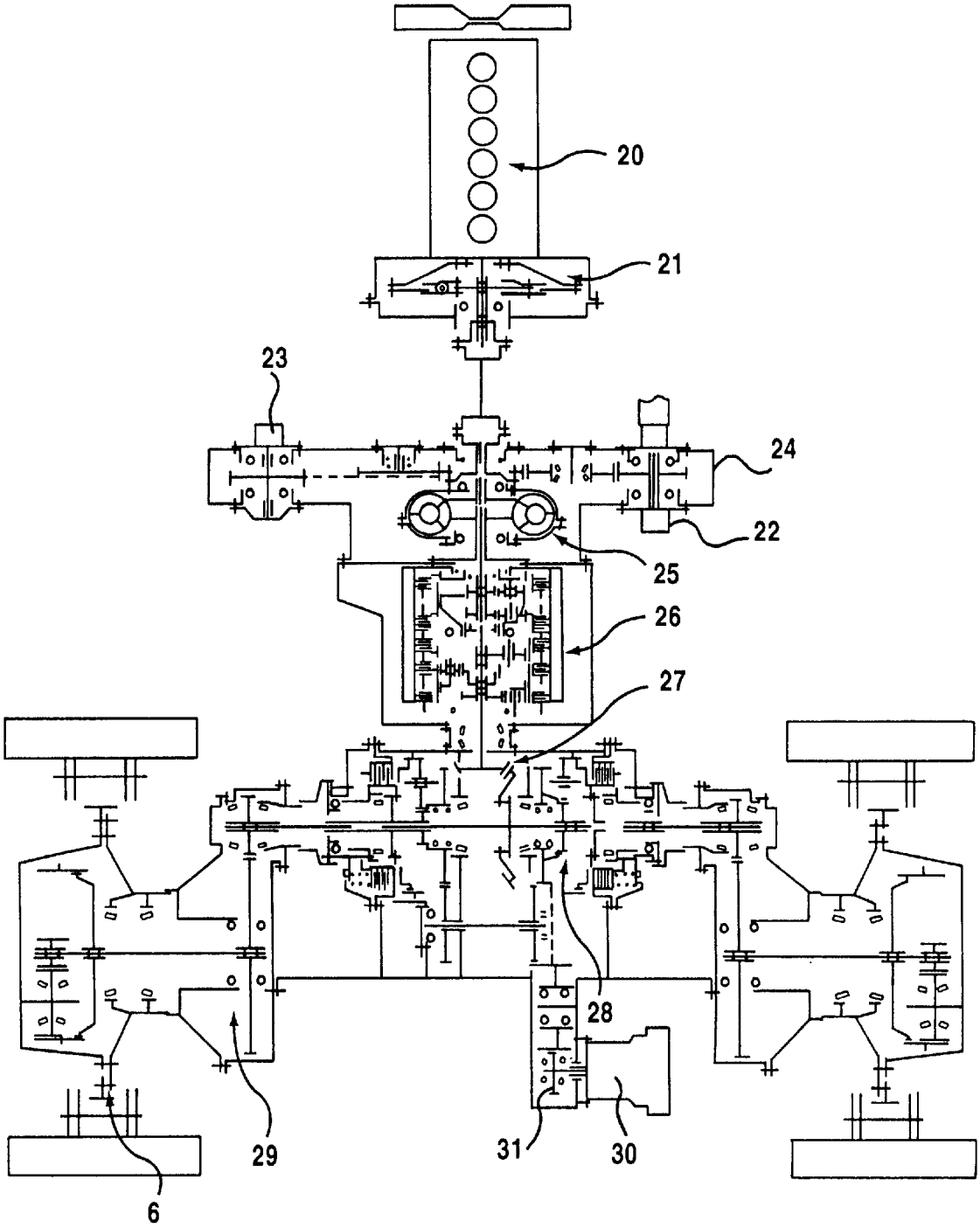
FIG. 2 shows a power transmission system according to the first embodiment.

Referring to FIG. 2 which shows a power transmission system, the rotary driving power of the engine 20 is transmitted to a damper 21 and a PTO 24 for driving various hydraulic pumps including an implement hydraulic pump 22 and an HSS pump (steering hydraulic pump) 23 and then to a torque converter 25. The rotary driving power is then transmitted from the output shaft of the torque converter 25 to a transmission 26 (e.g., wet multiple disc clutch type planetary gear transmission) which has an input shaft connected to the output shaft of the torque converter 25. The transmission 26 comprises a forward drive clutch, a reverse drive clutch and first to third speed clutches, so that the output shaft of the transmission 26 is rotated in three speed ranges in both forward drive and reverse drive. The rotary driving power from the output shaft of the transmission 26 is transmitted to an HSS unit 28 including differential planetary gears, through a bevel gear 27. The driving power is then transmitted from the HSS unit 28 to a pair of final reduction gear mechanisms 29 to power the respective sprockets 6 for running the crawler belts 5. The HSS unit 28 is drivingly coupled to a pinion 31 that is, in turn, attached to the output shaft of an HSS motor (steering hydraulic motor) 30 driven by the above steering hydraulic pump 23.

Figure 3:
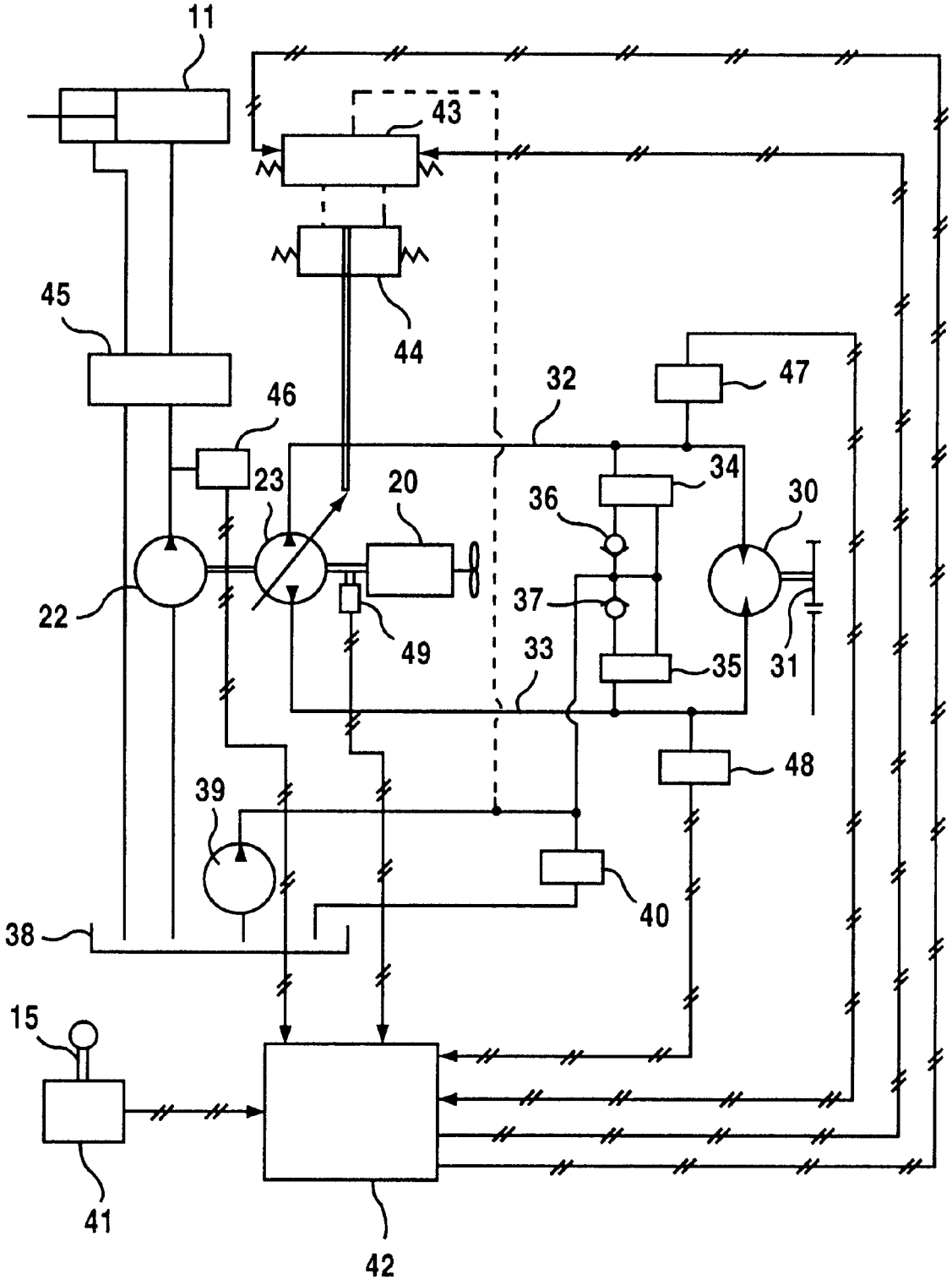
FIG. 3 shows the structure of a control system according to the first embodiment.

Referring to FIG. 3 showing the system structure of the control system made according to the first embodiment, the steering hydraulic pump 23 driven by the engine 20 is a variable displacement hydraulic pump and the oil discharged from the steering hydraulic pump 23 flows through a fluid path 32 or fluid path 33 and then into the steering hydraulic motor 30 composed of a fixed displacement hydraulic motor. The steering hydraulic circuit including the steering hydraulic pump 23 and the steering hydraulic motor 30 is an independent closed circuit. The steering hydraulic motor 30 is forwardly rotated by the pressure oil discharged from one side of the steering hydraulic pump 23 and reversely rotated by the pressure oil discharged from the other side of it. The fluid paths 32, 33 are respectively connected to a tank 38 through closed circuit relief valves 34, 35 and through check valves 36, 37. It should be noted that reference numerals 39 and 40 denote a fixed charging pump and a relief valve for a charging circuit, respectively.

As has been mentioned earlier, the HSS unit 28 including the differential planetary gears is drivingly connected to the output shaft of the steering hydraulic motor 30 through the pinion 31. With this HSS unit 28, the travel speed of the crawler belts 5 is controlled to turn the vehicle body 2. It should be noted that when the angle of the swash plate for the steering hydraulic pump 23 is zero, the steering hydraulic motor 30 is stopped so that the vehicle body 2 is not in turning motion.

When the steering lever 15 is manually operated, the voltage corresponding to the position of the steering lever 15 is output from a potentiometer 41 and a signal indicative of the output voltage is input to a controller 42. An output signal from the controller 42 is input to a servo solenoid valve 43. In response to switching of the servo solenoid valve 43, the piston position of a pump servo 44 is controlled by pressure oil, so that the angle of the swash plate of the steering hydraulic pump 23 is adjusted according to the piston position.

In the implement hydraulic circuit for operating implement hydraulic cylinders typically represented by the blade lift cylinder 11, the implement hydraulic pump 22 consisting of a fixed displacement hydraulic pump (a gear pump is used in this embodiment) is used. The oil discharged from the implement hydraulic pump 22 is supplied through an operating valve 45 to pressure chambers on the bottom side and head side of the implement hydraulic cylinders such as the blade lift cylinder 11, so that the implement hydraulic cylinders are operated.

In this embodiment, the power horse consumption of the implement hydraulic pump 22 is sensed and the angle of the swash plate for the steering hydraulic pump 23 is controlled so as to limit the maximum horse power consumption of the implement hydraulic pump 22 and the steering hydraulic pump 23. To enable this control, there are provided i) a hydraulic sensor 46 for detecting the discharge pressure of the implement hydraulic pump 22; ii) hydraulic sensors 47, 48 for respectively detecting the oil pressures in the fluid paths 32, 33 which connect the steering hydraulic pump 23 to the steering hydraulic motor 30; and iii) an engine rotation sensor 49 attached to the output shaft of the engine 20, and detection signals from the sensors 46, 47, 48 and 49 are entered to the controller 42. The controller 42 performs desired arithmetic operation in response to these input signals and outputs a control signal to the servo solenoid valve 43 according to the result of the operation, so that the angle of the swash plate for the steering hydraulic pump 23 is controlled by the servo solenoid valve 43 and the pump servo 44.

Figure 4:
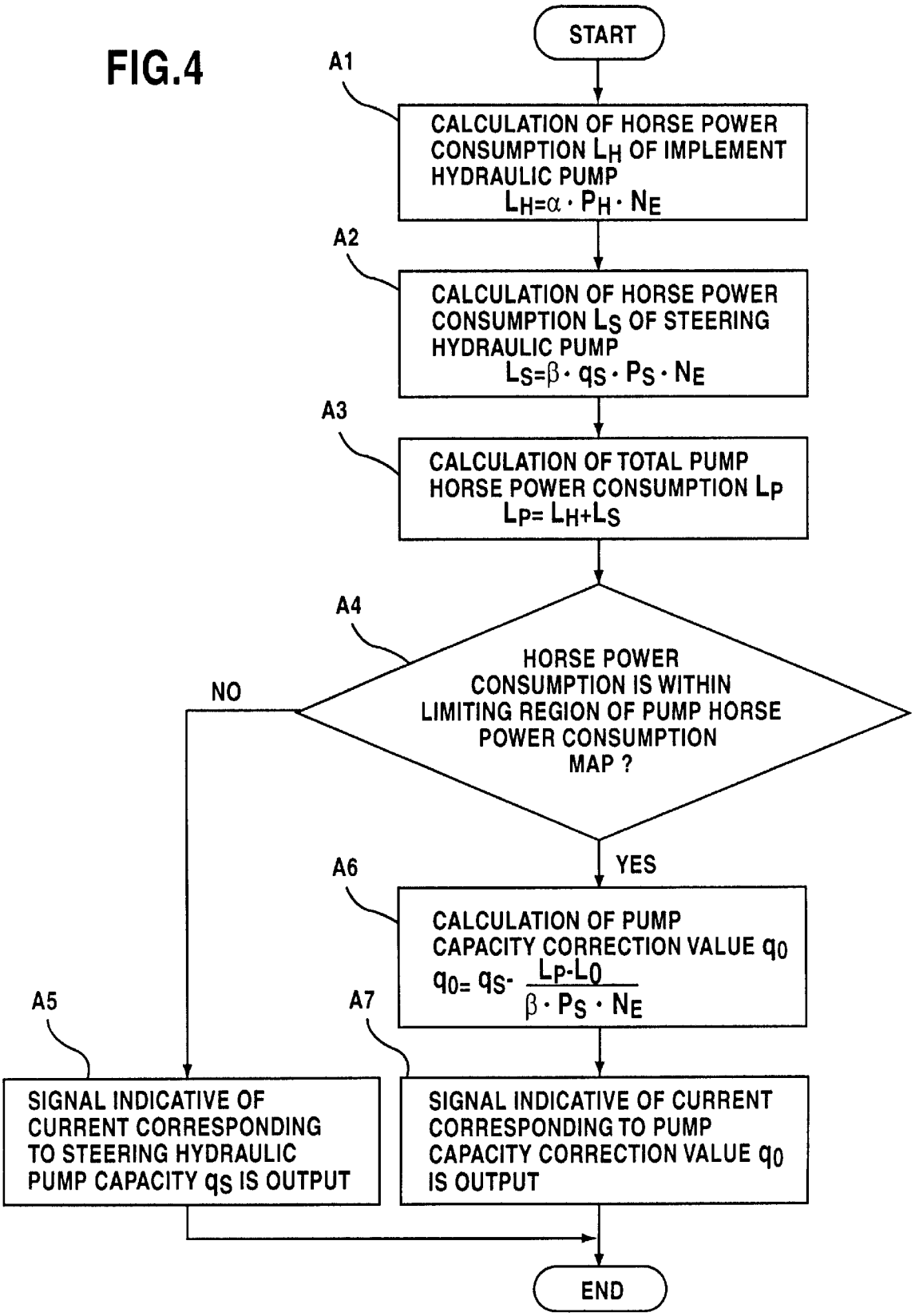
FIG. 4 is a flow chart of swash plate angle control designed according to the first embodiment.

Now reference is made to the flow chart of FIG. 4 to describe the swash plate angle control according to the first embodiment.

A1: Using the following equation, the horse power consumption $L_H$ of the implement hydraulic pump 22 is calculated from the discharge pressure $P_H$ of the implement hydraulic pump 22 detected by the hydraulic sensor 46 and from the rotational speed $N_E$ of the engine 20 detected by the engine rotation sensor 49.

$$L_H = \alpha \cdot P_H \cdot N_E$$

$\alpha$: constant

A2: Using the following equation, the power horse consumption $L_S$ of the steering hydraulic pump 23 is calculated from the discharge pressure $P_S$ of the steering hydraulic pump 23 detected by the hydraulic sensor 47 (or 48) and from the rotational speed $N_E$ of the engine 20 detected by the engine rotation sensor 49.

$$L_S=\beta\cdot q_S\cdot P_s\cdot N_E$$

β: a constant $q_S$: steering pump capacity determined by the operational position of the steering lever 15

A3: The total horse power consumption $L_P$ of the pumps is calculated from the following equation.

$$L_P=L_H+L_S$$

Figure 5:
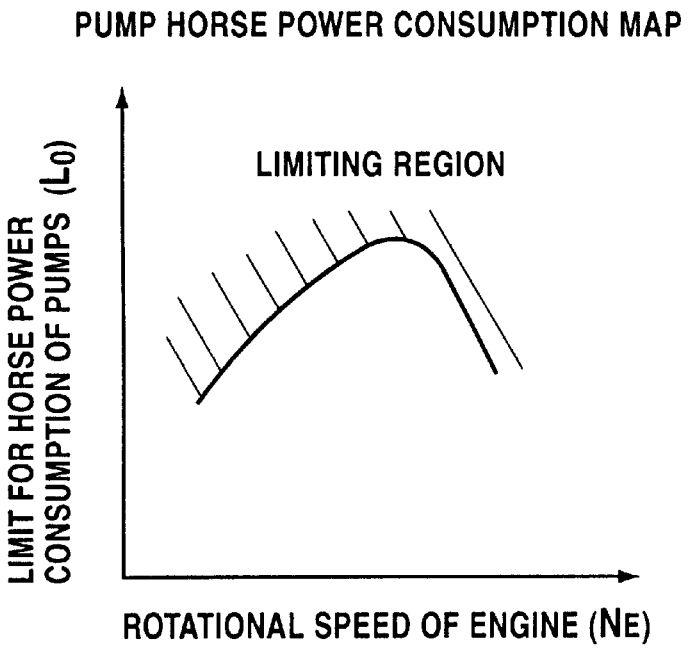
FIG. 5 shows a pump horse power consumption map.

A4: It is determined whether or not the total horse power consumption $L_P$ obtained in Step A3 falls within a limiting region specified in a pump horse power consumption map. The pump horse power consumption map is as shown in FIG. 5 and the limiting region is represented by the hatched area above the pump horse power consumption limit curve $L_0$ that is set according to the output curve of the engine. If the total horse power consumption $L_P$ is within this region, the prescribed control is to be performed.

Figure 6:
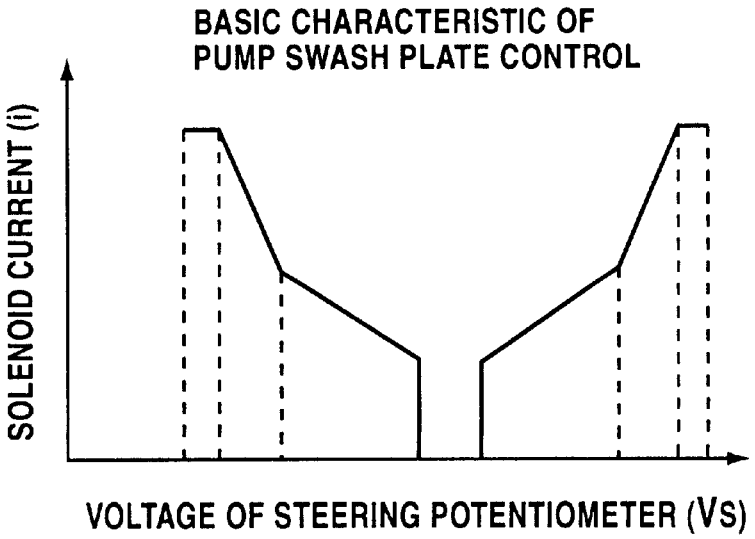
FIG. 6 is a graph showing the basic characteristic of pump swash plate control.

A5: If the total horse power consumption $L_P$ is not within the limiting region (the hatched area in FIG. 5) of the pump horse power consumption map, it is not necessary to limit the capacity of the steering hydraulic pump 23 and therefore a signal indicative of a current value corresponding to the steering pump capacity $q_S$ determined by the operational position of the steering lever 15 is output to the servo solenoid valve 43 to thereby control the angle of the swash plate for the steering hydraulic pump 23. The basic characteristic of the swash plate control is as shown in FIG. 6. According to this characteristic, if the voltage ($V_S$) of the potentiometer 41 is shifted from the center to the right or left, the solenoid current value output to the servo solenoid valve 43 is gradually increased according to the strokes of the lever.

A6 to A7: If the total horse power consumption $L_P$ is within the limiting region (i.e., the hatched area in FIG. 5) of the pump horse power consumption map, a pump capacity correction value $q_0$ is calculated from the following equation in order to limit the maximum horse power consumption. Then, a signal indicative of a current value corresponding to the pump capacity correction value $q_0$ thus calculated is output to the servo solenoid valve 43, thereby controlling the angle of the swash plate for the steering hydraulic pump 23.

$$q_0=q_S-(L_P-L_0)/(\beta\cdot P_S\cdot N_E)$$

With the control system of this embodiment, there is no need to set high engine torque rise and set high torque in the low speed range in order to prevent engine stalling when operating the implement hydraulic pump and the steering hydraulic pump at the same time. This leads to a reduction in the fuel cost required when the construction machine is driven in the medium or low speed range. In addition, since a gear pump of the fixed displacement type is used as the implement hydraulic pump, the system structure can be simplified, resulting in cost reduction.

(Second Embodiment)

While the first embodiment is designed to control the angle of the swash plate for the steering hydraulic pump based on the calculation of the horse power consumption of the implement hydraulic pump and the steering hydraulic pump, the second embodiment is directed to more simplified arrangement in consideration of the fact that the rotational speed of the engine is substantially stable, in which the desired control is performed only by detecting the discharge pressure of the implement hydraulic pump. The system structure of the second embodiment is basically similar to the one shown in FIG. 3 except that the second embodiment does not include the hydraulic sensors 47, 48 in the steering hydraulic circuit nor the engine rotation sensor 49. Therefore, a detailed description on the substantially same parts as those of the first embodiment will be omitted.

Figure 7:
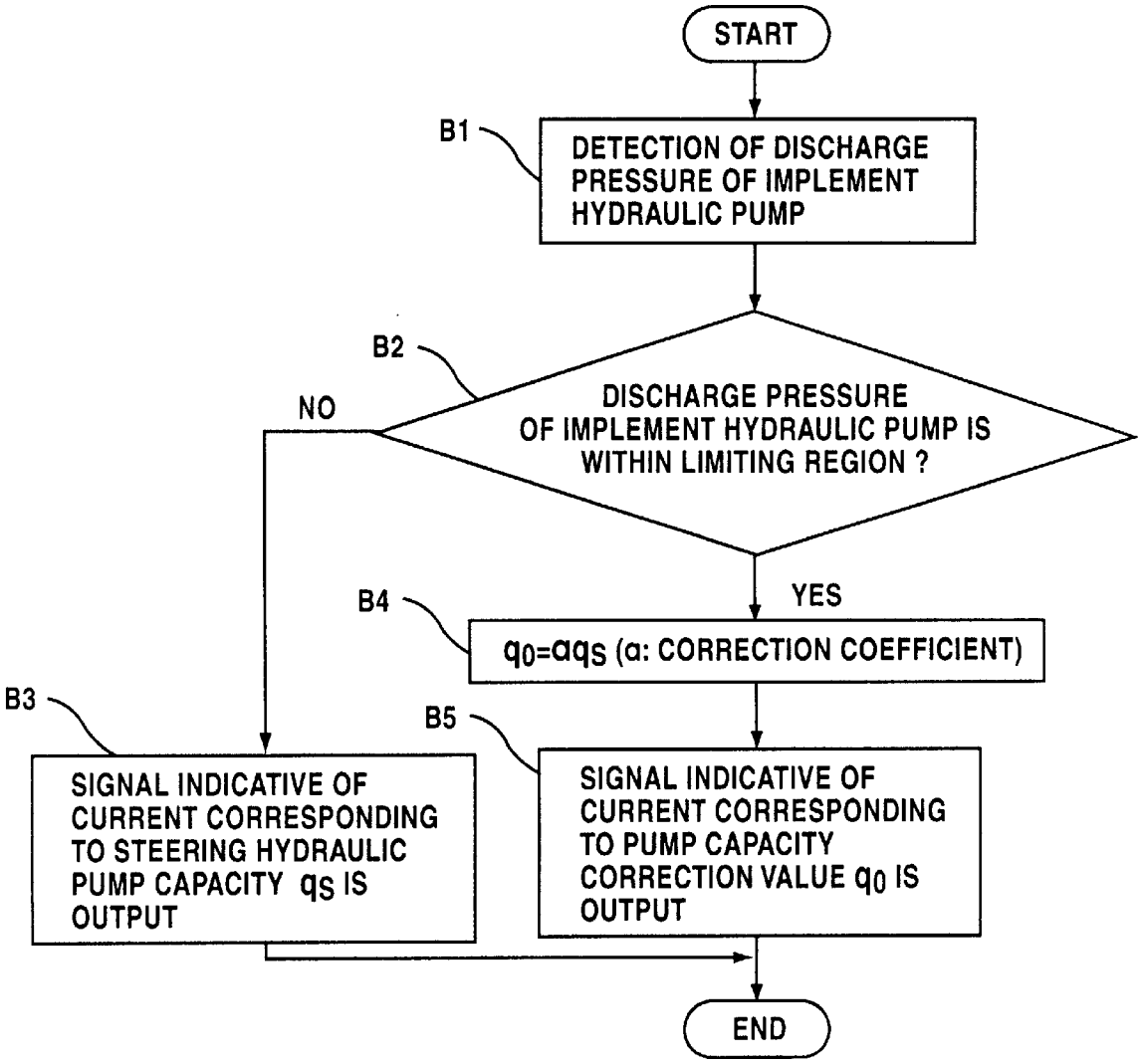
FIG. 7 is a flow chart of swash plate angle control designed according to a second embodiment.

With reference to the flow chart of FIG. 7, the swash plate angle control of the second embodiment will be described.

B1: The discharge pressure $P_H$ of the implement hydraulic pump 22 is detected by the hydraulic sensor (circuit hydraulic pressure detecting means) 46.

Figure 8:
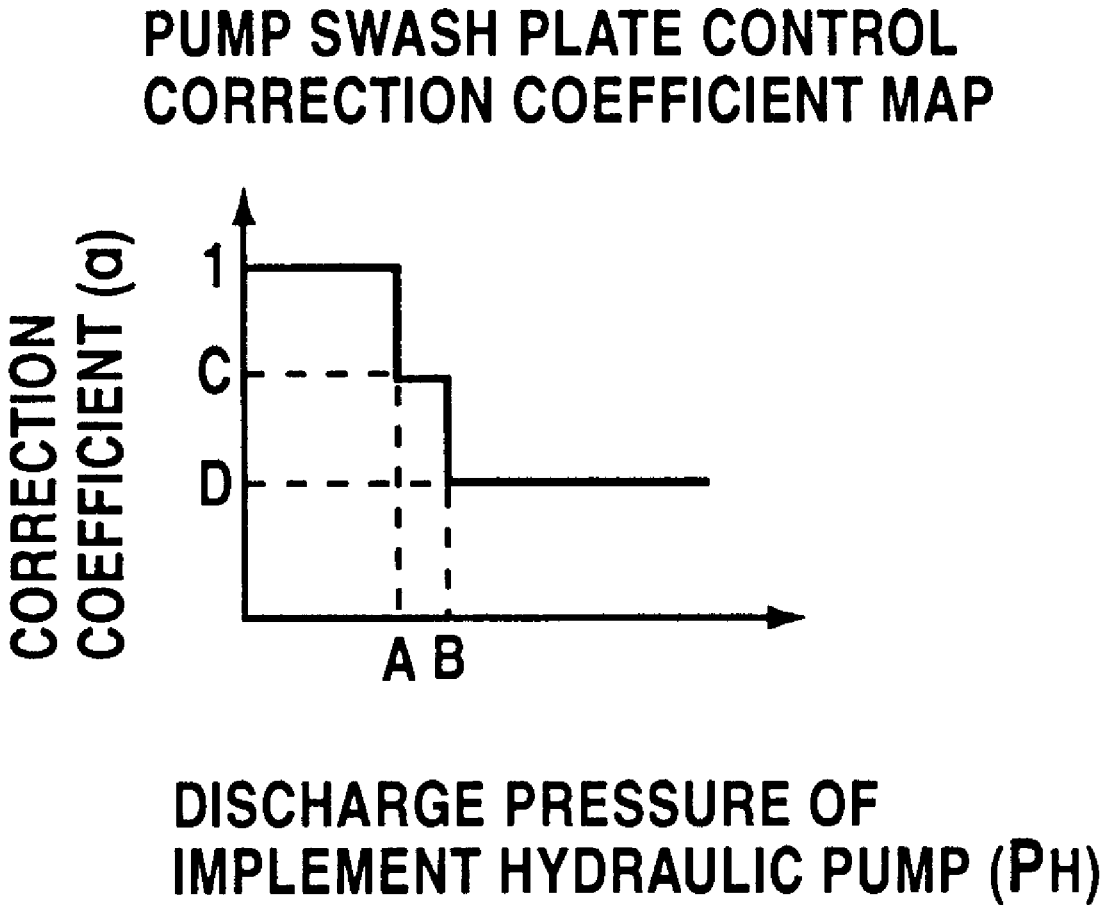
FIG. 8 shows a correction coefficient map for pump swash plate control.

B2: It is determined whether or not the detected, discharge pressure $P_H$ of the implement hydraulic pump 22 is within the limiting region (e.g., the pressure range of no less than 70 kg/cm$^2$), and a correction coefficient map is used depending on this determination. The correction coefficient map has the characteristic as shown in FIG. 8. Using this map, the value of the correction coefficient a is determined according to whether the discharge pressure $P_H$ of the implement hydraulic pump 22 satisfies $P_H<A$, or $A\leqq P_H<B$, or $B\leqq P_H$. Note that the value of A is, for instance, 70 kg/cm$^2$.

B3: If the discharge pressure $P_H$ of the implement hydraulic pump 22 does not fall within the limiting region, in other words, if the discharge pressure $P_H$ is less than A, it is not necessary to limit the capacity of the steering hydraulic pump 23. Therefore, the correction coefficient a is set to 1 and a signal indicative of a current value corresponding to the steering pump capacity $q_S$ determined by the operational position of the steering lever 15 is output to the servo solenoid valve 43, thereby controlling the angle of the swash plate for the steering hydraulic pump 23. In this case, the swash plate control is executed according to the basic characteristic shown in FIG. 6.

B4 to B5: If the discharge pressure $P_H$ of the implement hydraulic pump 22 is within the limiting region and satisfies $A\leqq P_H<B$, the correction coefficient a is then set to C (e.g., 0.9). If the discharge pressure $P_H$ is within the limiting region and satisfies $B\leqq P_H$, the correction coefficient a is set to D (e.g., 0.8). Then, a pump capacity correction value $q_0$ is calculated from the following equation in order to limit the value of current. A signal indicative of a current value corresponding to the calculated, pump capacity correction value $q_0$ is output to the servo solenoid valve 43, to control the angle of the swash plate of the steering hydraulic pump 23.

$$q_0=a\cdot q_S$$

With the more simplified system structure, the control system of the second embodiment can achieve the same effect as that of the first embodiment. That is, the second embodiment provides an inexpensive, compact system capable of providing high cost performance while preventing engine stalling which occurs when operating the implement hydraulic pump and the steering hydraulic pump at the same time.

In the second embodiment, the correction coefficient a may be set according to the type of operation (e.g., leveling, digging/carrying, side cutting, scraping) to be carried out, or according to the soil condition of the field (e.g., hard rock, sand). Examples of the means for changing the value of the correction coefficient a include a monitor with a resetting function, adjustable volume, IC card, and terminal.

We claim:

1. A method for controlling a construction machine, comprising the steps of:

actuating an implement hydraulic pump by an output of an engine to operate an implement attached to the construction machine;

actuating a variable displacement steering hydraulic pump by the output of the engine to turn a vehicle body of said machine;

detecting a load exerted on the implement and inputting, via at least one electrical signal, a detected load into a controller; and if it is determined by the controller that the detected load exceeds a preset value, the displacement of the steering hydraulic pump is reduced to reduce the load associated with turning of the vehicle body.

2. The method for controlling a construction machine, according to claim 1, wherein said preset value can be changed according to the type of operation to be carried out and the soil condition of the field where the construction machine is operated.

3. A system for controlling a construction machine, said system comprising an implement hydraulic circuit for actuating an implement hydraulic pump with the output of an engine to operate an implement attached to the construction machine, and a steering hydraulic circuit for actuating a variable displacement steering hydraulic pump with the output of the engine to turn a vehicle body of said machine by a steering hydraulic motor, said system further comprising:

(a) first horse power consumption detecting means for detecting the actual horse power consumption of the implement hydraulic pump;

(b) second horse power consumption detecting means for detecting the actual horse power consumption of the steering hydraulic pump;

(c) controlling region determining means for making a judgement whether or not the sum of the actual horse power consumption detected by the first and second horse power consumption detecting means falls within a specified controlling region in a map associated with the horse power consumption of the pumps; and (d) swash plate angle controlling means for controlling the angle of a swash plate for the steering hydraulic pump if the controlling region determining means judges that the sum of the actual horse power consumption falls within the specified controlling region.

4. The system for controlling a construction machine according to claim 3, wherein said implement hydraulic pump is a fixed displacement hydraulic pump.

5. The system for controlling a construction machine according to claim 3, wherein said swash plate angle controlling means controls the angle of the swash plate so as to reduce the displacement of the steering hydraulic pump, if the controlling region determining means judges that the sum of the horse power consumption falls within the specified controlling region.

6. The system for controlling a construction machine according to claim 5, wherein if said controlling region determining means judges that the sum of the horse power consumption falls within the specified controlling region, said swash plate angle controlling means calculates a pump capacity correction value $q_0$ for the steering hydraulic pump from the equation described by:

$$q_0=q_s-(L_p-L_0)/(\beta\cdot P_S\cdot N_E)$$

where $q_s$ is the capacity of the steering hydraulic pump, $L_p$ is the sum of the actual horse power consumption, $L_0$ is a limit for the horse power consumption of the pumps, $\beta$ is a constant, $P_S$ is the discharge pressure of the steering hydraulic pump, and $N_E$ is the rotational speed of the engine, and then, the swash plate angle controlling means outputs a signal indicative of a current value corresponding to the calculated pump capacity correction value $q_0$ in order to control the angle of the swash plate for the steering hydraulic pump.

7. A system for controlling a construction machine, said system comprising an implement hydraulic circuit for actuating an implement hydraulic pump with the output of an engine to operate an implement attached to the construction machine, and a steering hydraulic circuit for actuating a variable displacement steering hydraulic pump with the output of the engine to turn a vehicle body of said machine by a steering hydraulic motor, said system further comprising:

(a) circuit hydraulic pressure detecting means for detecting the hydraulic pressure of the implement hydraulic circuit;

(b) controlling region determining means for judging whether or not the hydraulic pressure detected by the circuit hydraulic pressure detecting means falls within a specified controlling region in a map associated with the hydraulic pressure of the circuit; and (c) swash plate angle controlling means for controlling the angle of a swash plate for the steering hydraulic pump if the controlling region determining means judges that the detected hydraulic pressure of the circuit falls within the specified controlling region.

8. The system for controlling a construction machine according to claim 7, wherein said implement hydraulic pump is a fixed displacement hydraulic pump.

9. The system for controlling a construction machine according to claim 7, wherein said swash plate angle controlling means controls the angle of the swash plate so as to reduce the displacement of the steering hydraulic pump, if said controlling region determining means judges that the detected circuit hydraulic pressure falls within the specified controlling region.

10. The system for controlling a construction machine according to claim 9, wherein if said controlling region determining means judges that the detected circuit hydraulic pressure falls within the specified controlling region, said swash plate angle controlling means calculates a pump capacity correction value $q_0$ for the steering hydraulic pump from the equation described by:

$$q_0=a\cdot q_s$$

where $q_s$ is the capacity of the steering hydraulic pump; and a is a correction coefficient that satisfies $0<a<1$, and then, said swash plate angle controlling means outputs a signal indicative of a current value corresponding to the calculated, pump capacity correction value $q_0$ in order to control the angle of the swash plate for the steering hydraulic pump.

* * * * *